United States Patent [19]

Grossiord

[11] Patent Number: 4,544,297

[45] Date of Patent: Oct. 1, 1985

[54] BALL POINT PEN VENTING

[75] Inventor: Claude R. Grossiord, Annecy, France

[73] Assignee: S. T. Dupont, Paris, France

[21] Appl. No.: 567,258

[22] Filed: Dec. 30, 1983

[30] Foreign Application Priority Data

Dec. 30, 1982 [FR] France ..... 82 22062

[51] Int. Cl.[4] ..... B43K 7/00; B43K 7/08; B43K 7/12

[52] U.S. Cl. ..... 401/217; 401/99; 401/107

[58] Field of Search ..... 401/99, 107, 108, 217, 401/153

[56] References Cited

U.S. PATENT DOCUMENTS

| | | | |
|---|---|---|---|
| 3,039,436 | 6/1962 | Exner | 401/108 X |
| 3,285,228 | 11/1966 | Fisher | 120/12.03 |
| 3,289,636 | 12/1966 | Tessier | 120/18 |
| 3,525,573 | 8/1970 | Fend | 401/108 |
| 3,583,820 | 6/1971 | Koeln | 401/107 |

FOREIGN PATENT DOCUMENTS

| | | | |
|---|---|---|---|
| 1561812 | 9/1967 | Fed. Rep. of Germany . | |
| 1561795 | 4/1970 | Fed. Rep. of Germany | 401/107 |
| 1561814 | 4/1970 | Fed. Rep. of Germany | 401/107 |
| 1561828 | 4/1970 | Fed. Rep. of Germany | 401/217 |
| 2209265 | 2/1972 | Fed. Rep. of Germany . | |
| 957611 | 2/1950 | France | 401/153 |
| 962176 | 6/1950 | France | 401/108 |
| 2451273 | 3/1979 | France . | |
| 581030 | 11/1974 | Switzerland | 401/107 |
| 1059530 | 2/1967 | United Kingdom . | |
| 2104848 | 3/1983 | United Kingdom . | |

*Primary Examiner*—Steven A. Bratlie

*Attorney, Agent, or Firm*—Raymond J. De Vellis

[57] ABSTRACT

An improvement in a ballpoint pen having an ink cartridge with a writing nib slidably mounted in the body of the pen and translatable between a resting position wherein the nib is retracted within the body of the pen and a writing position wherein the nib is disposed outside of the pen body, the ink cartridge being provided in the vicinity of the nib with at least one orifice for supplying the ink cartridge with air, the improvement including a chamber sealed from the ambient atmosphere in both the resting and writing positions, the orifice being disposed within the chamber, and an interruptable sealing mechanism for establishing communication between the chamber and the ambient atmosphere whenever the ink cartridge is translated between the resting and writing positions.

6 Claims, 9 Drawing Figures

BALL POINT PEN VENTING

BACKGROUND OF THE INVENTION

1. Field of the Invention

The present invention relates to ballpoint pens which utilize refill ink cartridges, particularly the maintaining of ambient pressure in such ink cartridges.

2. Description of the Prior Art

It is known that, in ink cartridges of this type, the head space between the back of the cartridge and the upper level of the ink should be kept as close as possible to ambient pressure, in order to prevent a pressure drop during writing which would oppose proper ink flow, as well as to prevent overpressurization which would result in overfeeding of the ink supply.

Thus, it has been proposed that the backward portion of the cartridge be provided with an orifice designed to insure pressure communication with the ambient atmosphere. Such an arrangement is satisfactory when the ink is of relatively low volatility. However, when the cartridge contains a relatively volatile ink formula, ongoing evaporation results in overconsumption of the ink.

In view of this disadvantage it has been proposed that an orifice or orifices be provided at the forward portion of the refill, and that the orifice or orifices be made to communicate with the backward portion thereof by the provision of a duct inside the ink reservoir. However, such a construction only prevents overconsumption of the ink to the extend that the user replaces the pen cap after each use.

SUMMARY OF THE INVENTION

One object of the present invention is the provision of an ink cartridge which insures satisfactory pressurization of the ink supply, as well as reduced evaporation thereof in the case where the user fails to replace the pen cap following use.

It is another object of the present invention to provide a pen having an adequately pressurized refill cartridge and not requiring the provision of a pen cap.

In general, the invention features an improvement in a ball point pen having an ink cartridge with a writing nib slidably mounted in the body of the pen and translatable between a resting position wherein the nib is retracted within the body of the pen and a writing position wherein the nib is disposed outside of the pen body, the ink cartridge being provided in the vicinity of the nib with at least one orifice for supplying the ink cartridge with air, the improvement including a chamber sealed from the ambient atmosphere in both the resting and writing positions, the orifice being disposed within the chamber, and an interruptable sealing mechanism for establishing communication between the chamber and the ambient atmosphere whenever the ink cartridge is translated between the resting and writing positions.

In a particularly useful embodiment of the invention, the space formed between the refill and the pen body over the entire length of the refill is used to form the chamber. It has been found sometimes useful to have a chamber with a relatively large volume to damp certain pressure variations likely to occur during use.

In another embodiment of the invention, the seal between the ink cartridge and the pen body includes a bellows to provide a practically frictionless air tight connection therebetween. Such an arrangement also provides a relatively permanent equilibrium to be established between the chamber pressure and the ambient pressure in both the resting and writing positions. In the writing position (and particularly in the case of pens having heat conductive bodies), this embodiment prevents pressure increases in the chamber due to heat transfer (e.g., from the user's hand) from producing an overabundant ink flow. In the resting position, it prevents the same type of incident when, due to changes in altitude (for example, in the case of an airplane flight), the pressure chamber is higher than atmospheric pressure. Since such pressure adjustments are not provided by the volume of the chamber, this embodiment enables small volume chambers to be used, something which is particularly useful in making ballpoint pens of small dimensions.

The above objects and features will now be made clear through the description of a number of preferred embodiments, reference being had to the accompanying drawings forming a part hereof, and wherein:

DESCRIPTION OF THE PREFERRED EMBODIMENTS

Figure 1:
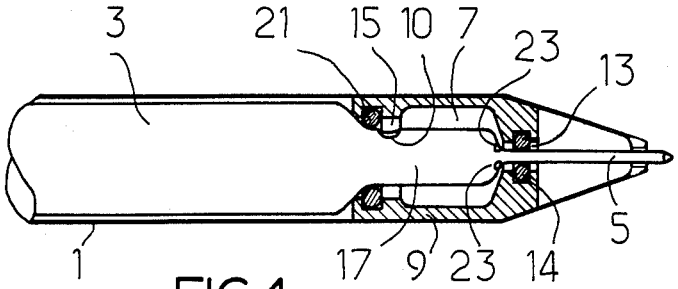
FIGS. 1, 2 and 3 are lenghwise cross-sectional views of a first embodiment of a ballpoint pen according to the present invention shown, respectively, in the writing position, the resting position, and an intermediate position therebetween.
Figure 2:
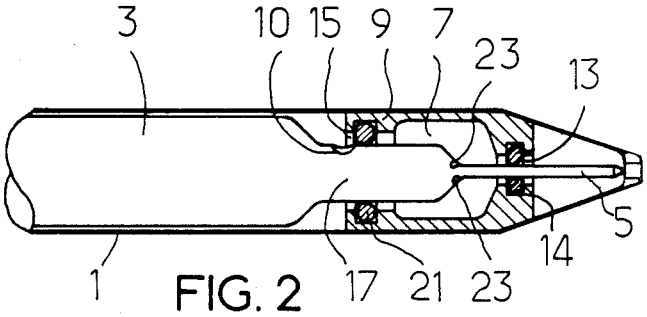
Figure 3:
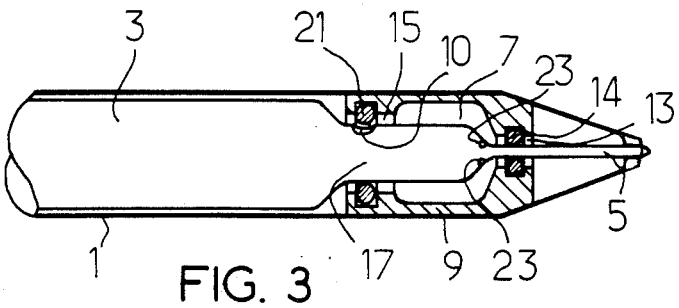

Referring now to FIGS. 1–3, a ballpoint pen is provided with a refill ink cartridge 3 ending in a writing nib portion 5.

A hollow cylindrical envelope 9, attached to the inside of the pen body, defines therein a cylindrical chamber 7, provided at each end with axial openings 13 for passage of nib 5 and 15 for passage of a forward portion 17 of cartridge body 3, respectively. Sealing between these two portions of the cartridge and cylindrical element 9 is provided by two O-rings 14 and 21.

Refill 3 is provided with two pressurization orifices 23, communicating via ducts, not shown in the drawing, with the gas-filled space between the back of the refill cartridge and the upper surface of the ink reservoir. A hollow groove 10 is provided on the external part of forward portion 17 of the cartridge body.

In FIG. 1, the cartridge is in the writing position and groove 10 is disposed within chamber 7. Chamber 7, and accordingly orifices 21, are isolated from the ambient atmosphere by O-rings 14 and 21.

The volume of chamber 7 is dimensioned such that, in the writing position, the pen can produce a given amount of writing with no notable pressure drop which could impede the ink flow.

Accordingly, the user can leave the pen in the writing position without risking a substantial evaporation of ink, since the allowable evaporation is limited by the relatively restricted volume of air within chamber 7.

In FIG. 2, nib 5 is retracted, groove 10 is inside the pen body, and chamber 7 is once more isolated from the ambient atmosphere, as are orifices 23, by O-rings 14 and 21. Excessive evaporation is therefore also prevented in the resting position.

On the other hand, in the intermediate position shown in FIG. 3, groove 10 is disposed opposite O-ring 21 and a passage is thus formed, enabling chamber 7 to communicate with the ambient atmosphere. Thus, every time the cartridge passes from the resting position to the writing position and vice versa, chamber 7 is placed in communication with the atmosphere and thus stores a given volume of air at atmospheric pressure.

Figure 4:
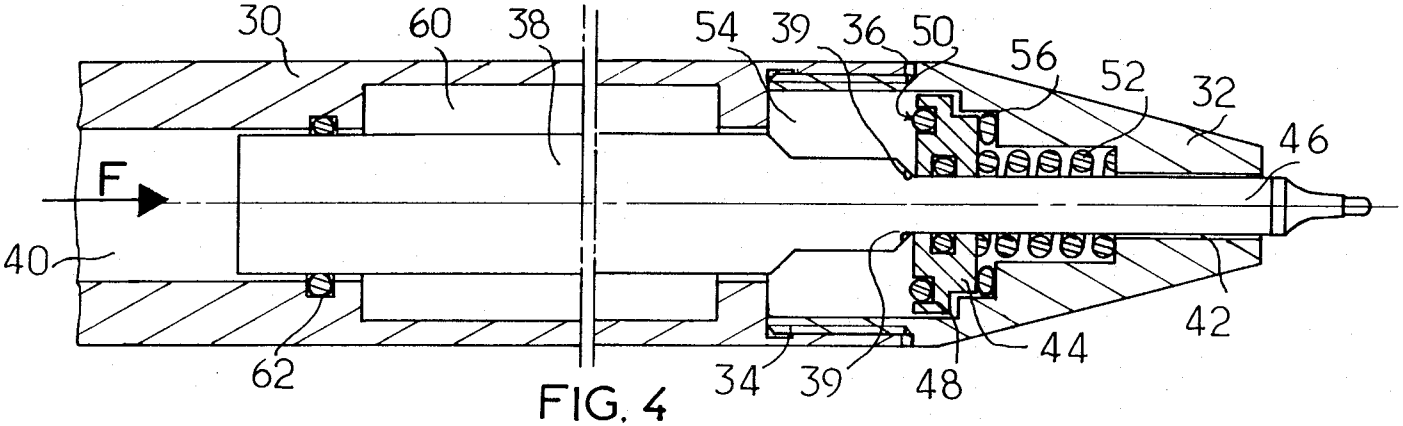
FIGS. 4 and 5 are lengthwise sections of a second embodiment of a ballpoint pen according to the invention, in the writing position and resting position, respectively.
Figure 5:
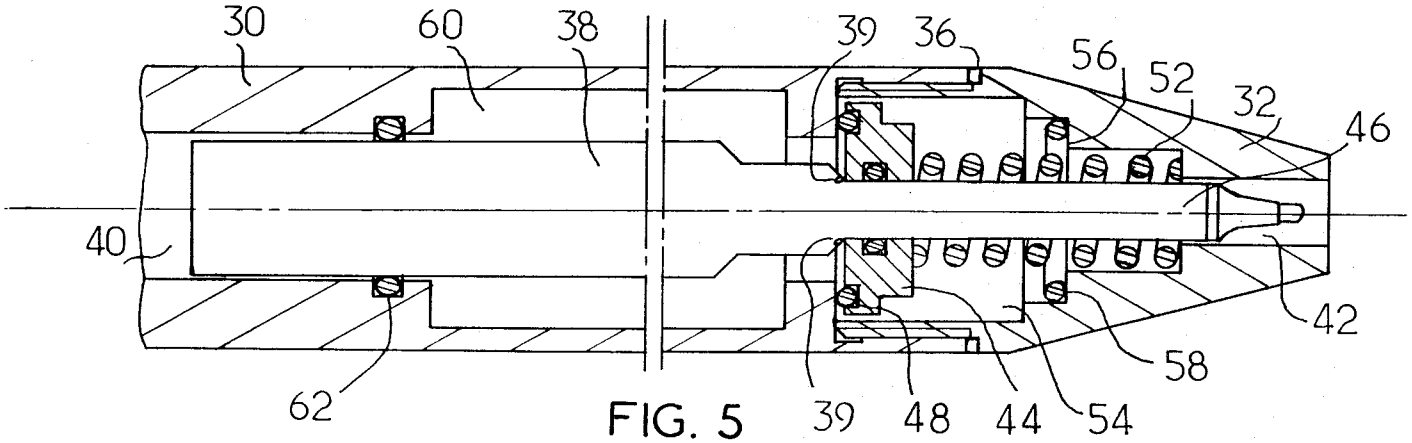

In the embodiment shown in FIGS. 4 and 5, the body of a pen according to the invention is composed essentially of a tube 30 and a writing head 32 attached to tube 30 by a thread 34 with interposition of a seal 36.

An ink cartridge 38, provided with pressurization orifices 39, is slidably mounted in stepped bores 40 and 42 provided in tube 30 and head 32, respectively.

A valve 44 is sealably and fixedly mounted on nib 46 of ink cartridge 38 and is provided with a circular groove 48 in which there is mounted an O-ring 50. Valve 44 reciprocates during movement of the ink cartridge 38, within a cavity 54 provided in writing head 32. An O-ring 58 is mounted in the bottom of cavity 54 against a shoulder 56.

Tube 30 contains a cylindrical cavity 60 in communication with cavity 54. An O-ring 62 provides a seal between ink cartridge 38 and tube 30.

As shown in FIG. 4, when a force F is exerted on the cartridge against a compression spring 52 by means not shown in the drawing, valve 44 comes into contact with seal 56, and the pressurization orifices of the cartridge are then in communication with the sealed chamber defined by cavities 60 and 54.

Such an arrangement thus permits a relatively large portion of the volume of the pen to be utilized for the chamber controlling the pressure inside the cartridge.

As shown in FIG. 5, when the force F is removed from the cartridge, spring 52 biases seal 50 of valve 44 against the body of the pen. Pressurization orifices 23 are then disposed within sealed cavity 60. It is found that in this position the volume of the chamber is considerably reduced since it is limited to cavity 60 alone. The evaporation of ink in the resting position is thus considerably reduced. It will be noted however that is is possible to reduce them even further by dimensioning cavity 60 to have a smaller volume.

Figure 6:
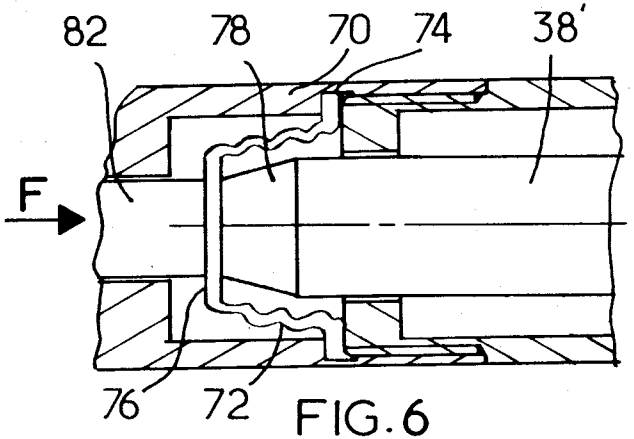

In FIG. 6, the seal between cartridge 38' and pen body 70 is provided by an elastic bellows 72. The base 74 of bellows 72 is attached in a sealed fashion to body 70 and its top 76 comes into contact with the top 78 of cartridge 38'.

End 82 of a pushbutton, actuated by means not shown in the drawing, permits the cartridge to be maintained in the writing position by acting in the direction of force F.

Provision of bellows 72 ensures a perfect seal between body 70 and cartridge 38' by permitting virtually frictionless axial displacement of the latter. Moreover, the flexibility of this bellows is such that it further enables the pressure differences likely to form between the chamber and the ambient atmosphere to be offset.

Figure 7:
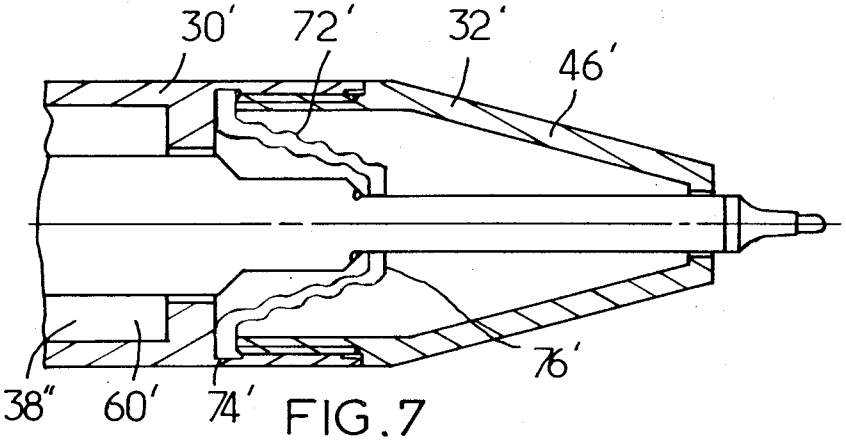
FIGS. 6 and 7 are partial sections of two alternate constructions for providing a seal between the ink cartridge and the pen body.

As shown in FIG. 7, a bellows 72' can also be disposed at the forward portion of the pen. In this embodiment, a bellows 72' is attached by its base 74' to tube 30' with the aid of writing head 32'. Top 76' of bellows 72' is traversed in an airtight manner by nib 46'. The venting of chamber 60' to the atmosphere is then controlled at the back of the pen, for example by the arrangement shown in FIG. 9. Here a cylindrical cavity 54' is provided in the back of body 70' of the pen. The two lateral faces 86 and 88 of cavity 54' are provided with sealing O-rings 90 and 92, respectively. A valve 94 is attached to the back 78' of cartridge 38'.

In the resting position (in the absence of force F), a spring 96 biases valve 94 against O-ring 90. Cavity 54' is then isolated from the ambient atmosphere but is in communication via pressurization orifices provided on cartridge 38' (not represented in this drawing) with the gas-filled space above the ink, and evaporation of the ink is therefore limited.

In the writing position (when an opposing force F compresses spring 96), valve 94 comes into contact with O-ring 92. The chamber formed forward of valve 94 is then isolated from cavity 54' which is in communication with the atmosphere.

Figure 9:
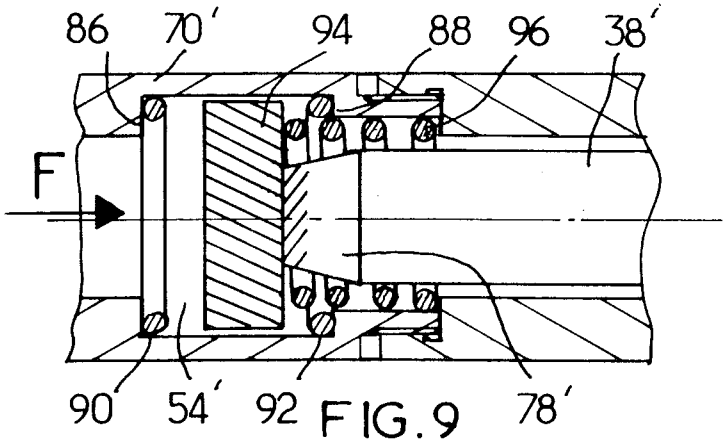
FIG. 9 is a partial section of an alternative embodiment of a ballpoint pen according to the invention.

During passage from the resting position to the writing position valve 94 is in the position illustrated in FIG. 9 and the chamber is in communication with the ambient atmosphere and becomes filled with air at this pressure.

Figure 8:
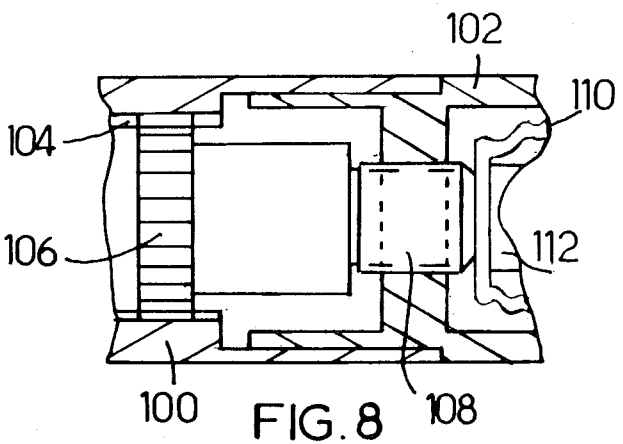
FIG. 8 is a partial section showing a construction for activating a ballpoint pen according to the invention.

Of course, movement of the cartridge can be accomplished by any sliding element known in the art. As shown in FIG. 8, it can be activated by a rotary action. A cap 100 is rotatably mounted on the body 102 of a pen. A screw 108 is screwed into the body thereof and comes to rest on bellows 110 in contact with ink cartridge 112. Screw 108 has a toothed crown 106 which engages grooves 104 in the cap. Rotation of cap 100 causes rotation of screw 108 and hence its lengthwise movement, and as a consequence, lengthwise movement of ink cartridge 112.

While the present invention has been illustrated through the description of a number of preferred embodiments, various substitutions of equivalents may be effected without departing from the spirit or scope of the invention as set forth in the following claims.

What is claimed as new and desired to be secured by Letters Patent of the United States is:

1. In a ballpoint pen having an ink cartridge with a writing nib slidably mounted in the body of the pen and translatable between a resting position wherein said nib is retracted within the body of the pen and a writing position wherein said nib is disposed outside of the pen body, said ink cartridge being provided in the vicinity of said nib with at least one orifice for supplying said ink cartridge with air, the improvement comprising:

a chamber sealed from the ambient atmosphere in both said resting position and said writing position, said orifice being disposed within said chamber; and interruptable sealing means for establishing communication between said chamber and the ambient atmosphere whenever said ink cartridge is translated between said resting and writing positions.

2. A pen according to claim 1, wherein said chamber comprises an open volume bounded by said pen body and said ink cartridge, said chamber being sealed from the ambient atmosphere at a first end by additional sealing means enabling translation of said ink cartridge with respect thereto and being provided at a second end thereof with said interruptable sealing means.

3. A pen as in claim 2, wherein said additional sealing means comprises an O-ring disposed between said pen body and said ink cartridge.

4. A pen according to claim 2, wherein said additional sealing means comprises a bellows sealingly attached to said ink cartridge.

5. A pen according to claim 1, wherein said interruptable sealing means comprises a seal disposed between said pen body and said ink cartridge, and a groove provided on said ink cartridge, said groove being so disposed on said ink cartridge such that, in the writing position, said groove is in communication with only said chamber, while in the resting position, said groove is in communication with only the ambient atmosphere, and in an intermediate position, said groove is in communication with both said chamber and said ambient atmosphere to provide for the passage of air therebetween.

6. A pen according to claim 1, wherein said interruptable sealing means comprises a cavity, one end of which is in communication with the ambient atmosphere and the other end of which is in communication with said chamber, and a valve fixedly attached to said ink cartridge, said valve being so disposed on said ink cartridge so as to block communication between the ambient atmosphere and said chamber in both the resting and writing positions and establish communication between said ambient atmosphere and said chamber when translating between the resting and writing positions.

* * * * *